US011542813B2

(12) United States Patent
Dubois-Decool et al.

(10) Patent No.: US 11,542,813 B2
(45) Date of Patent: Jan. 3, 2023

(54) DEVICE FOR ACQUIRING AND COMMUNICATING DATA BETWEEN STRINGS OF OIL WELLS OR GAS WELLS

(71) Applicant: VALLOUREC OIL AND GAS FRANCE, Aulnoye-Aymeries (FR)

(72) Inventors: Sylvie Dubois-Decool, Boulogne-Billancourt (FR); Daniel Khoda Rahmi, Boulogne-Billancourt (FR); Eric Donzier, Versailles (FR); Emmanuel Tavernier, Versailles (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 39 days.

(21) Appl. No.: 17/264,107

(22) PCT Filed: Jul. 31, 2019

(86) PCT No.: PCT/EP2019/070615
§ 371 (c)(1),
(2) Date: Jan. 28, 2021

(87) PCT Pub. No.: WO2020/025667
PCT Pub. Date: Feb. 6, 2020

(65) Prior Publication Data

US 2021/0310350 A1 Oct. 7, 2021

(30) Foreign Application Priority Data

Aug. 2, 2018 (FR) ..... 18 57240

(51) Int. Cl.
*E21B 47/01* (2012.01)
*E21B 47/13* (2012.01)
(Continued)

(52) U.S. Cl.
CPC ..... *E21B 47/13* (2020.05); *E21B 47/01* (2013.01); *E21B 47/07* (2020.05); *E21B 47/10* (2013.01)

(58) Field of Classification Search
CPC ..... E21B 47/13; E21B 47/07; E21B 47/10; E21B 47/01
See application file for complete search history.

(56) References Cited

U.S. PATENT DOCUMENTS

2002/0158120 A1* 10/2002 Zierolf ..... E21B 17/006 235/375
2013/0269945 A1 10/2013 Mulholland et al.
(Continued)

FOREIGN PATENT DOCUMENTS

WO WO 2012/018322 A1 2/2012
WO WO 2015/167934 A1 11/2015

OTHER PUBLICATIONS

International Search Report dated Oct. 16, 2019 in PCT/EP2019/070615 filed on Jul. 31, 2019, 3 pages.

*Primary Examiner* — Brad Harcourt
(74) *Attorney, Agent, or Firm* — Oblon, McClelland, Maier & Neustadt, L.L.P.

(57) ABSTRACT

The invention relates to oil wells and/or gas wells and more particularly a device and a method for acquiring and transmitting data in the wells based on an equipped tubular component (1) which comprises an internal surface (2), an external surface (3) and a main axis (X), an internal antenna (4) which is located on the side of the internal surface (2), an external antenna (5) which is located on the side of the external surface (3), which may comprise an opening (6) which extends from the external surface (3) and opens onto the internal surface (2), an electrical conductor extending in said opening (6).

18 Claims, 4 Drawing Sheets

(51) Int. Cl.
*E21B 47/07* (2012.01)
*E21B 47/10* (2012.01)

(56) References Cited

U.S. PATENT DOCUMENTS

| | | | | |
|---|---|---|---|---|
| 2014/0026621 | A1 | 9/2014 | Godager | |
| 2014/0305662 | A1* | 10/2014 | Giroux | E21B 33/146 166/65.1 |
| 2015/0000982 | A1* | 1/2015 | Mcdowell | F16K 3/03 175/57 |
| 2016/0258277 | A1 | 9/2016 | Bittar et al. | |
| 2016/0341030 | A1 | 11/2016 | Mulholland et al. | |
| 2018/0058206 | A1 | 3/2018 | Zhang et al. | |
| 2018/0058208 | A1 | 3/2018 | Song et al. | |

* cited by examiner

DEVICE FOR ACQUIRING AND COMMUNICATING DATA BETWEEN STRINGS OF OIL WELLS OR GAS WELLS

The invention relates to oil and/or gas wells and more particularly to a device for acquiring and transmitting data in the wells.

An oil or gas well generally comprises a plurality of tube strings. It comprises at least two of these, a casing string and a tubing string. A well structure usually comprises two or more casing strings and one tubing string. The spaces between two adjacent tube strings or between the largest-diameter tube string of a well and the rock formation are referred to as annular spaces. These annular spaces may be at least partially filled with cement or with wall-supporting filler fluids. It is beneficial to monitor the physical or chemical parameters within these spaces, such as the pressure and the temperature, the pH, the dihydrogen sulfide concentration, the carbon dioxide concentration, the concentration of chlorides or of water so as to detect abnormal events within the well, such as a leak, an undesirable buildup of fluid or of gas or the onset of conditions of use not anticipated at the time of construction.

The tubes used for constructing the oil or gas wells are generally made of steel, and comprise tubes of great length, which is to say of lengths in excess of 6 meters and tubes of shorter length referred to as coupling sleeves which connect the long tubes together. The corresponding threaded connections are referred to as threaded & coupled (T&C). There are also long-length tubes connected directly to one another by connections referred to as integral connections, in which male and female parts are produced on the tube itself.

The tube strings are intended to be used for several years in an oil or gas well. The ability to withstand aging is studied in great depth according to the grade of steel used, the characteristics of the tubes and of their connections, and also the environmental conditions and conditions of use of the equipment. There is a need to monitor how the environmental conditions and conditions of use in the well evolve.

Monitoring devices employing cables installed on the tubes are known, but these solutions are difficult to install, particularly in the case of casing strings.

US2018058208 discloses a device for transmitting data along a drilling string and using acoustic waves transmitted through the wall of the tube. That device does not allow a transmission of data between strings of the one same well to be established, and does not allow the monitoring of various annular spaces of a well.

These known devices do not allow the various annular spaces of a well to be monitored.

The known devices do not allow the conditions in the well at different depths and the different annular spaces of the well to be monitored. These is a need for a device that allows an operator to monitor parameters relating to the conditions of operation of the equipment in various annular spaces and for the device to allow the collection of data relating to the conditions in various annular spaces without burdensome dismantling operations or without the need to install complex equipment at the well head or in the well bottom.

The invention relates to an equipped tubular component comprising an interior surface, an exterior surface and a main axis (X), an interior antenna situated on the side of the interior surface, an exterior antenna situated on the side of the exterior surface. This arrangement allows a signal to be received and transmitted from the inside toward the outside or from the outside toward the inside of the equipped tubular component according to the invention. It also allows a signal to be received and transmitted from the inside toward the outside of an assembly of tubular components or, conversely, allows a signal to be received or transmitted from the outside toward the inside of an assembly of tubular components.

According to one aspect, the equipped tubular component may comprise an opening extending from the exterior surface and opening onto the interior surface, an electrical conductor extending into said opening.

According to one aspect, which the opening comprises a sealing surface of the metal-to-metal type, which makes it possible to prevent liquid or gas leaking from one annular space to the other via the opening.

According to one aspect, the equipped tubular component may comprise a sensor module, which allows measurements to be taken in a given annular space.

Said sensor module may comprise at least one sensor selected from a pressure sensor, a temperature sensor, a fluid flowrate sensor, a pH sensor, a concentration sensor sensing the concentration of dihydrogen sulfide, of carbon dioxide, of chlorides or of water.

In one variant, the sensor module comprises a pressure sensor, a temperature sensor and a fluid flowrate sensor.

The sensor module may be arranged on the exterior surface of the equipped tubular component, so as to take measurements in the given annular space.

According to one aspect, the equipped tubular component may further comprise a communication module comprising electronics designed to emit a data signal through an interior antenna or exterior antenna.

According to another aspect, the interior antenna is an interior winding of a conducting wire and the exterior antenna is an exterior winding of a conducting wire.

The equipped tubular component may comprise at least one exterior pocket able to house the sensor module and/or the communication module.

The equipped tubular component may comprise an external reinforcement on the exterior surface to protect the interior antenna from debris and from the flow of fluids circulating on the outside of the component.

The equipped tubular component may comprise at least one cavity in the exterior surface. The number of cavities is preferably comprised between 2 and 20. The cavities are advantageously distributed circumferentially around the equipped tubular component. As a preference, the cavities extend axially in a similar way to the first exterior pocket. The cavities are typically axial grooves. These cavities make it possible to improve the structural integrity of the equipped tubular component.

The equipped tubular component may comprise a locking sleeve designed to block the interior antenna axially in position.

The equipped tubular component may comprise a screw thread situated at least at one of its ends and configured in such a way as to allow screwed connection to another tubular component comprising a complementing screw thread.

The equipped tubular component is intended for the construction of oil or gas wells.

The invention also relates to an oil or gas well structure comprising at least a first and a second tube string and at least a first and a second equipped tubular component according to the invention, the first equipped tubular component being mounted on a first tube string and the second equipped tubular component being mounted on a second tube string, the first tube string being directly adjacent to and concentric with the second threaded tube string.

The invention also relates to an oil or gas well structure comprising at least a first equipped tubular component according to the invention wherein the interior antenna is a first interior antenna, the exterior antenna is a first exterior antenna, and at least a second equipped tubular component according to the invention, wherein the interior antenna is a second interior antenna, the exterior antenna is a second exterior antenna, the first tubular component being mounted at a given depth in a first string of the oil or gas well, the second tubular component being mounted in a second string of said oil or gas well, which string is adjacent to the first string, at said given depth, so as to allow a signal to be transmitted between the first and second equipped tubular components. The oil or gas well structure may comprise more than two equipped tubular components according to the invention.

The oil or gas well structure according to the invention may form a device for acquiring and communicating data between the strings of the well.

Finally, the invention also relates to a method for monitoring and for communication in an oil or gas well, comprising the steps of:

- measuring temperature and pressure conditions at a certain depth in a first annular space using a first sensor module situated on a first equipped tubular component,
- measuring temperature and pressure conditions at said certain depth in a second annular space using a second sensor module situated on a second equipped tubular component,
- transmitting data measured by the second sensor module of the second equipped tubular component to said first equipped tubular component.

LIST OF FIGURES

FIG. 1 schematically shows a conventional oil or gas well structure.

FIG. 2 schematically shows a well structure and one example of the implementation of an acquisition and communication system according to the invention.

FIG. 3 schematically shows a well structure and a second example of the implementation of an acquisition and communication system according to the invention.

DETAILED DESCRIPTION

Figure 1:
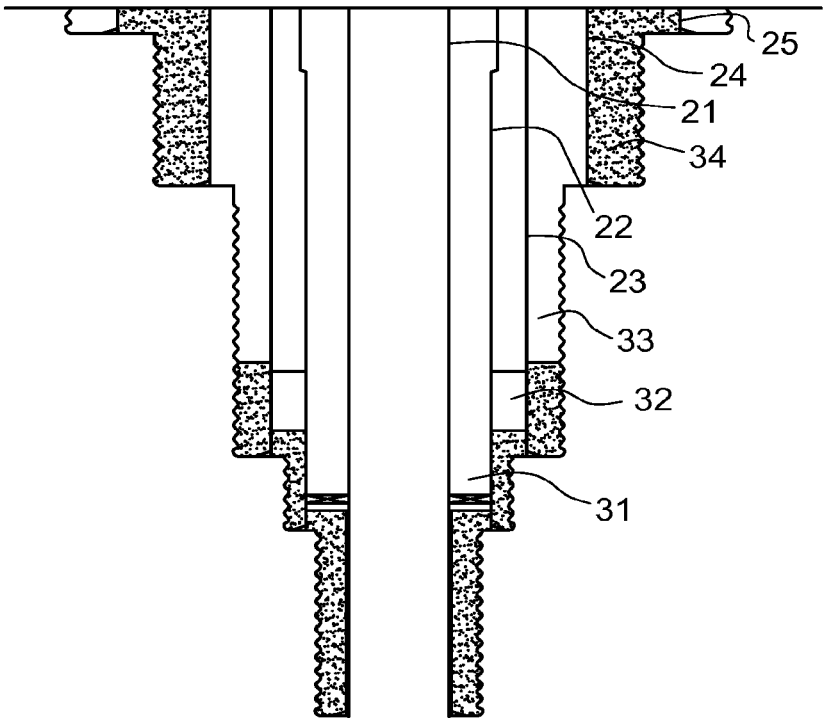

The well of FIG. 1 is depicted schematically and shows one of the current structures of an oil or gas well with 5 tube strings.

A string generally comprises tubular components comprising tubes of great length, ranging from 8 meters to 15 meters, connected in the case of threaded and coupled systems by components of shorter length, referred to as coupling sleeves, generally ranging from 0.8 meters to 2 meters in length. In another case, the tubes are connected to one another directly. The assemblies are by means of screw threads.

The tube string 21 is an extraction string for example made up of tubes having a nominal outside diameter of 139.70 mm (five and a half inches), for example using a connection of the Threaded & Coupled (T&C) type, such as a VAM® 21 T&C. The string 22 is a tubing string of tubes having for example a nominal diameter of 250.83 mm (9⅞ inches). The string 23 is a tubing string of tubes for example of a nominal diameter of 346.08 mm (13⅜ inches). The string 24 is a surface tubing string for example made up of tubes with a nominal diameter of 508.00 mm (20 inches), for example having a T&C type connection of VAM® BIG OMEGA® type. The string 25 is a surface string of tubes for example having a nominal diameter of 762 mm (30 inches).

The longest string may run the entire length of the well and the shortest string may have a length ranging between 20 m and 200 m.

The number of strings, the tube diameters, the types of connection, the type of steel used are dependent on numerous parameters and vary greatly from one well to another.

These strings which are arranged concentrically, define between them annular spaces between the exterior wall of a smaller-diameter string and the interior surface of an immediately adjacent larger-diameter string. For example, the strings 21 and 22 define an annular space 31, the strings 22 and 23 define an annular space 32, the strings 23 and 24 define an annular space 33, the strings 24 and 25 define an annular space 34. The annular spaces may contain cement used to consolidate the structure of the well, or else liquids such as drilling mud, stabilizing mud, or else a gaseous phase. The remainder of the description will be based on this example of a general well structure but without implying limitation as to the number of tube strings, the diameters, the connections used, and the equipment employed.

Figure 2:
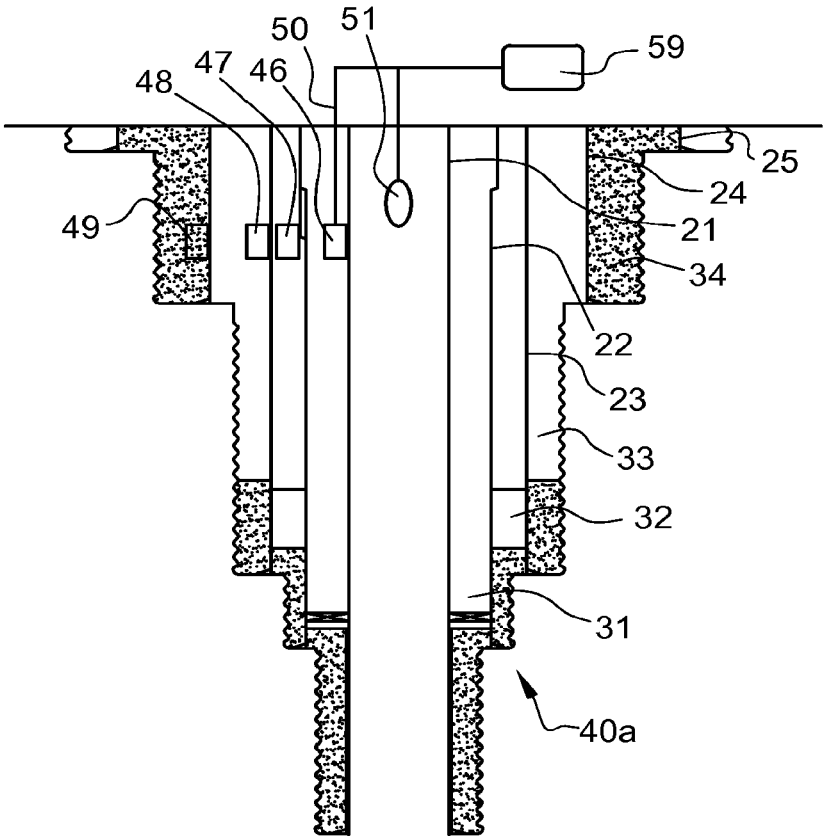

FIG. 2 shows a well 40*a* comprising equipped tubular components according to a first embodiment of the invention. The well 40*a* comprises, over at least two strings, namely 4 strings (21, 22, 23, 24) in the embodiment of FIG. 2, equipped tubular components (46, 47, 48, 49) in accordance with the invention and comprising measurement and communication devices.

These components are preferably situated at a shallow depth, for example at a depth of 10 m to 50 m below the level of a well head.

The equipped interior tubular component 46 comprises a first sensor designed to measure parameters relating to the conditions in one annular space.

The parameters measured may be selected from pressure, temperature, fluid flowrate, pH, the concentration of dihydrogen sulfide, of carbon dioxide, of chlorides or of water. In the remainder of the description, for the sake of simplicity, pressure and temperature have been chosen as the parameters monitored. Thus, in the example of FIG. 2, the first sensor module comprises a pressure and temperature sensor designed to measure the pressure and temperature in the first annular space 31.

It must be understood that the sensor module may comprise one or more sensors selected from a pressure sensor, a temperature sensor, a fluid flowrate sensor, a pH sensor, a concentration sensor sensing the concentration of dihydrogen sulfide, of carbon dioxide, of chlorides or of water. Also, the various equipped tubular components used in a well may have different sensors so as to monitor different parameters at different depths within a well.

The measurements taken can be stored in a memory integrated into processing electronics of the sensor module.

The equipped interior tubular component 46 comprises a first signal transmission module designed to receive information signals sent by a first equipped intermediate tubular component 47.

In a first variant depicted in FIG. 2, the first signal transmission module may comprise a communication module communicating data to the surface and arranged on the interior surface of the equipped tubular component 46 so as to be able to communicate with a probe 51 placed at the same depth as the interior equipped tubular component 46. The probe 51 is connected to a surface unit 59 designed to process the data measured by the equipped tubular components.

In an alternative variant also depicted in FIG. 2, the first signal transmission module may comprise a communication element communicating data toward the surface and arranged on the exterior surface of the interior equipped tubular component 46 so as to be able to communicate via a cable 50 with a surface unit 59 containing electronics designed to collect all of the data measured by the equipped tubular components. The cable 50 may be fixed along the tubular component on the outside thereof.

Said communication module corresponds to a transmission unit.

The first intermediate equipped tubular component 47 comprises a second sensor module designed to measure the pressure, the temperature and the pH in the second annular space 32 and a first signal transmission module designed to receive information signals sent by a second equipped intermediate tubular component 48.

The second intermediate equipped tubular component 48 comprises a third sensor module designed to measure the pressure and the temperature in the third annular space 33, and a first signal transmission module designed to receive data information signals sent by an equipped exterior tubular component 49 and comprising a memory designed to store the corresponding data.

The equipped exterior tubular component 49 comprises a second sensor module designed to measure the pressure and the temperature in the fourth annular space 34 and a first signal transmission module designed to send and receive information signals with the second equipped intermediate tubular component 48.

A transmission module may be designed to send and/or receive information signals to and/or from the or both of the transmission modules situated at the same depth in the adjacent strings.

Figure 3:
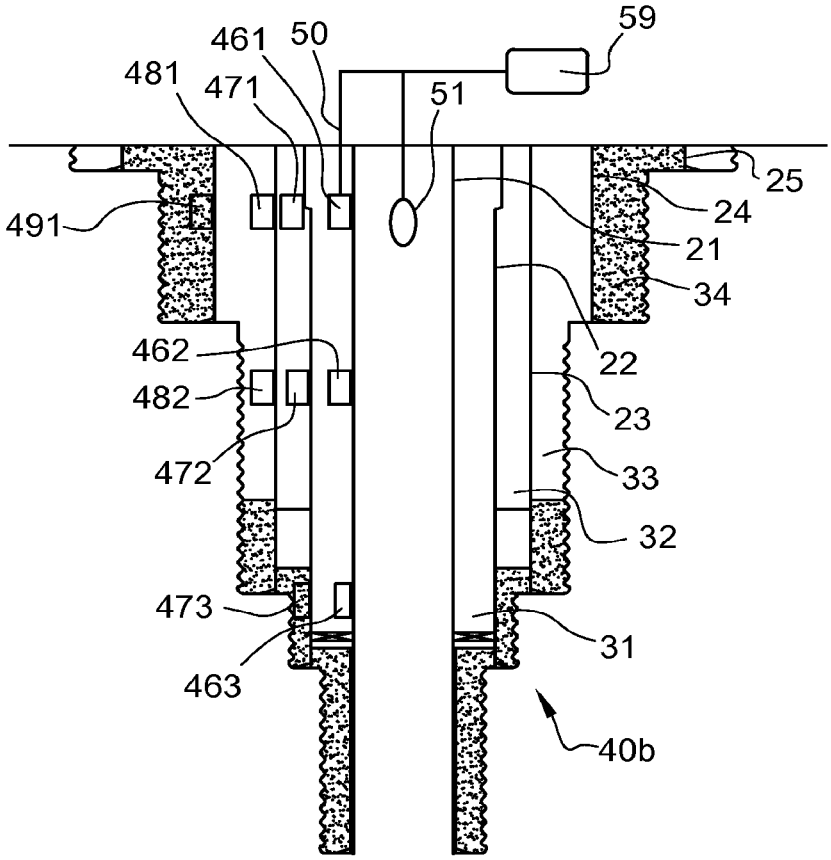

FIG. 3 shows a wellbore string 40*b* according to a second example of implementation of the invention. The string 40*b* comprises over at least two strings and at a first depth, equipped tubular components (461, 471, 481, 491) according to the invention and comprising measurement and communication devices.

The string 40*b* also comprises, at least at a second depth, equipped tubular components (462, 472, 482) according to the invention and comprising measurement and communication devices. The string 40*b* also comprises, at least at a third depth, equipped tubular components (463, 473) according to the invention and comprising measurement and communication devices.

It will be appreciated that, because the strings of a well are not all the same length, there may be a different number of strings present at a given depth and therefore there may be a different quantity of equipped tubular components situated at that same depth, for a given depth. Nevertheless, there has to be at least two equipped tubular components on different strings positioned at substantially the same depth. The expression "substantially the same depth" may be understood to mean a depth that is the same to within plus or minus 2 meters. An assembly of equipped tubular components situated at substantially the same depth is referred to as a group of equipped tubular components.

One embodiment of well comprising several groups of equipped tubular components according to the invention, with each of these groups being situated at different depths within the well allows greater precision in the measurements, which are then taken at different depths, but may prove more demanding in its implementation in terms of the lengths of the components inserted into a string and in terms of the register of the components so as to ensure that the equipped tubular components are indeed at substantially the same depth. The equipped tubular components according to the invention make it possible to compensate for offsets of a few meters in depth in order to allow the signal from one equipped tubular component to be transmitted to another equipped tubular component.

One advantage with the use of antennas in the form of solenoids also allows greater data transmission from the larger-diameter equipped tubular component toward the smaller-diameter equipped tubular component thanks to the property of greater uniformity of the magnetic fields inside or along the axis of a solenoid. It is thus possible to obtain a greater data rate in this direction, while having the possibility of having in the opposite direction a data rate that is lower in value but still enough to send operating instructions to the communication modules and sensor modules of the other equipped tubular components, for example commands relating to requests to transmit stored measurements or requests to modify measurement frequency, or requests for diagnostics regarding the operational status of the electronics, and power reserves.

Figure 4:
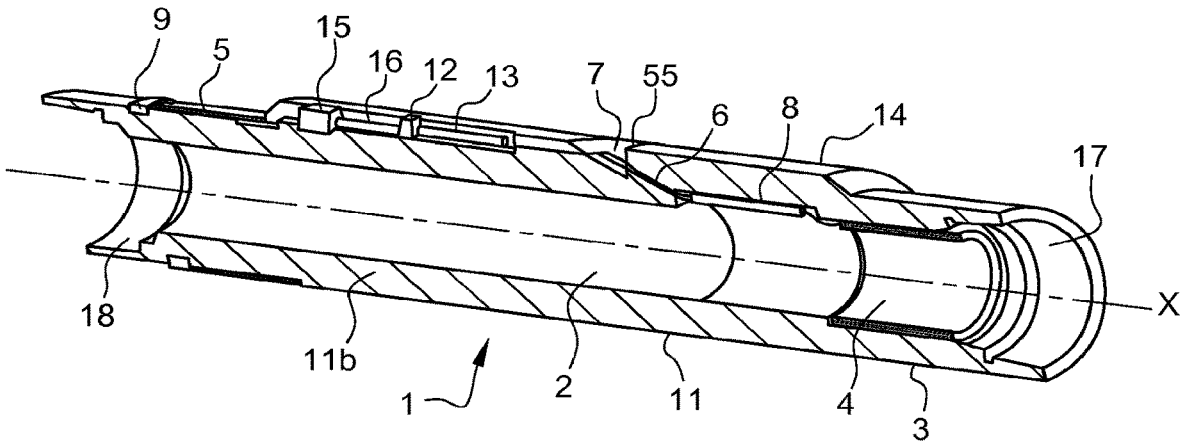
FIG. 4 shows, in partial section, an equipped tubular component according to one embodiment of the invention.

In FIG. 4, an equipped tubular component 1 according to the invention comprises a tubular body 11 having an interior surface 2, an exterior surface 3 and comprising two threaded ends 17, 18 separated by a central portion 11*b* of the tubular body 11. The body 11 is made of metal, preferably steel.

The equipped tubular component 1 comprises a first exterior antenna 5 situated on the side of the exterior surface 3, a first interior antenna 4 situated on the side of the interior surface 2. In one embodiment, the interior antenna 4 is situated closer to a first end 17 of the tubular component whereas the exterior antenna 5 is situated closer to a second end 18 of the tubular component. In another embodiment, the interior antenna 4 and the exterior antenna 5 are both situated closer to the one same end of the tubular component, either the first end 17 or the second end 18.

The equipped tubular component 1 also comprises an opening 6 extending from the exterior surface 3 as far as the interior surface 2.

The opening 6 may extend from a first exterior pocket 7 situated on the exterior surface 3.

Figure 6:
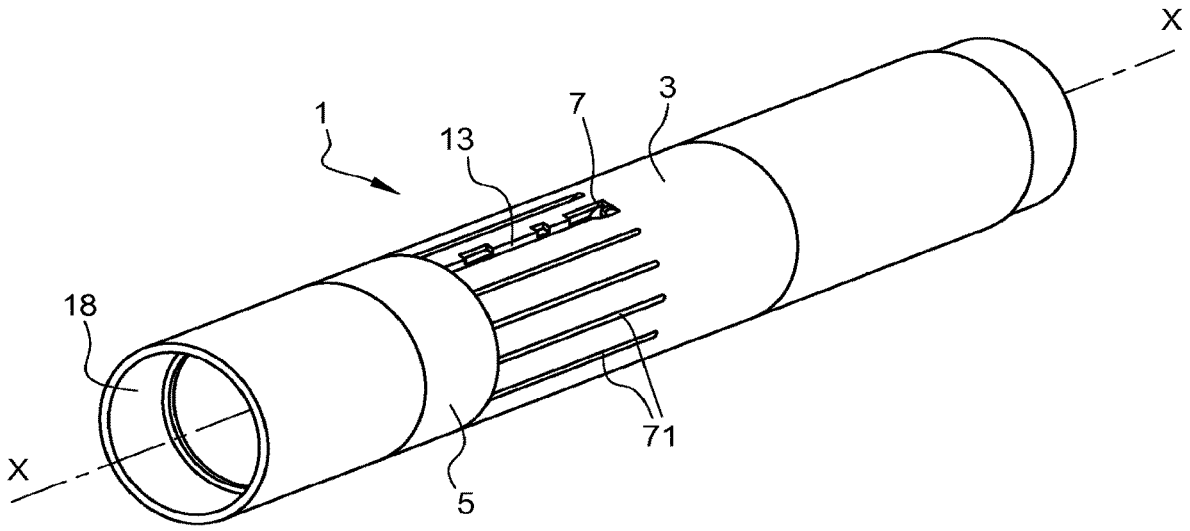
FIG. 6 shows, in partial section, an equipped tubular component according to another embodiment of the invention.

The equipped tubular component 1 may comprise at least one cavity 71 in the exterior surface 3. The number of cavities 71 is preferably comprised between 2 and 20, and more preferably still, between 5 and 20. When the number of cavities 71 is equal to or greater than 2, the cavities 71 are advantageously distributed circumferentially around the equipped tubular component. The cavities 71 and the exterior pocket 7 are advantageously distributed equidistant from one another. As a preference, the cavities 71 extend axially in a similar way to the first exterior pocket 7. FIG. 6 illustrates a variant of this embodiment in which the second exterior pocket 13 is elongate and substantially parallel to the axis X of the tube, and the cavities 71 are grooves parallel to the axis X of the equipped tubular component 1.

The opening 6 houses an electrical conductor extending from the exterior surface 3 or the exterior pocket 7 as far as the first interior antenna 4.

The equipped tubular component 1 may comprise a sheath 8 to protect the electrical conductor.

The equipped tubular component 1 comprises a sensor module 12. The sensor module 12 may comprise a pressure and temperature sensor, or a sensor sensing fluid flow, pH, or the like. The sensor module 12 may be located in a second exterior pocket 13 made on the exterior surface 3. The sensor module 12 may comprise a battery intended to power the sensor as well as a clock able to trigger the taking of measurements at predefined time intervals, these intervals being able to range from 200 ms to several days, weeks or months.

The exterior surface 3 may comprise an additional thickness 14 intended to allow the making of the first and second exterior pockets (7 and 13) while at the same time maintaining the mechanical or structural strength of the tubular component.

The sensor module 12 may be held in the second exterior pocket 13 by screw-fastening or force fitting. The sensor module 12 may also be partially encapsulated in epoxy, so as to leave one face free for taking the measurements.

The equipped tubular component 1 comprises a first transmission unit 15 situated in the vicinity of an antenna. In the embodiment of FIG. 4, the transmission unit is arranged in the second exterior pocket 13 in the vicinity of the exterior antenna 5.

The first transmission unit 15 comprises electronics designed to emit and receive signals to and from the first interior antenna 4 and first exterior antenna 5.

The first transmission unit comprises a memory designed to store the data relating to the measurements taken by the sensor module 12. The first transmission unit 15 is connected to a battery 16 for storing the power for the operation of the transmission unit 15. The first transmission unit may comprise an emitter designed to emit a signal at a first predefined frequency.

The battery 16 may also power the sensor unit 12. Alternatively, a second battery may be installed and dedicated to the sensor unit 12.

Advantageously, the transmission unit 15 may comprise conversion electronics, comprising an energy converter for storing electricity in the battery 16 from currents generated in the antennas by an exterior electromagnetic field, thereby allowing the batteries to be recharged and the life of the equipment to be lengthened. The conversion electronics may also be designed to generate a current in an antenna at a charging frequency intended to generate charge in an antenna of an adjacent equipped tubular component.

In a well, it is then possible to recharge the interior tubular component 46 by direct contact with the cable or via a current induced in the first interior antenna by electromagnetic waves generated by the probe of the first intermediate tubular component 47, and the second intermediate equipped tubular component 48 can then generate a charging field via its exterior antenna so as to charge the first intermediate equipped tubular component 47, and so on, as far as the largest-diameter equipped tubular component of the group of equipped tubular components at a given depth. This makes it possible to avoid a maintenance operation that would entail a costly halt in production.

The first interior antenna 4 may be a circular coil and may comprise an electrically conducting wire encapsulated in a material of the polymer, polyetheretherketone (PEEK), silicone or polyetherketone type.

The first interior antenna 4 may extend axially over a distance ranging from 15 cm to 80 cm.

The first exterior antenna 5 may be a circular coil and may comprise an electrically conducting wire encapsulated in a material of the polymer, polyetheretherketone (PEEK), silicone, or polyetherketone type.

The first exterior antenna 5 may extend axially over an axial length ranging from 40 centimeters to 3 meters. The conducting wire of the antenna may make between 50 and 500 turns over this axial length.

The opening 6 may have a diameter ranging between 2 and 4 mm. The opening 6 may be produced by drilling. The opening 6 may have a main axis oriented perpendicularly to the main axis (X) of the tubular component. Alternatively, the opening 6 may have an orientation at an angle of between 15° and 75° with respect to the main axis (X) of the equipped tubular component.

In one embodiment, the equipped tubular component 1 is a sleeve comprising a first transmission unit 15 including electronics designed to emit and receive signals to and from the first interior antenna 4 and first exterior antenna 5, an opening 6, extending from a first exterior pocket 7 situated on the exterior surface 3, and a sensor module 12 comprising sensors sensing pressure and temperature or fluid flow or pH or else strain gauges or the like. In some instances, dimensional gauges may be used with a dedicated setup. The opening 6 houses an electrical conductor extending from the exterior surface 3 or the exterior pocket 7 as far as the first interior antenna 4. The electrical conductor is also connected to the first transmission unit 15. The sleeve according to the invention comprises a central section that is lengthened in order to accommodate the interior and exterior antennas.

The first exterior pocket 7 may have an angled wall 55 at 50 to 80° to the main axis (X) of the equipped tubular component 1, and into which the opening 6 may open. On the opposite side, the opening 6 may open onto the interior surface into an annular groove 56 intended to accommodate a connector to the first interior antenna 4.

The equipped tubular component may comprise an external reinforcement 9 on the exterior surface in order to protect the interior antenna 4 from debris and from the flow of fluids circulating on the outside of the component, which is to say on the outside of the string. The external reinforcement 9 may be a circular insert mounted the tubular component.

Figure 5:
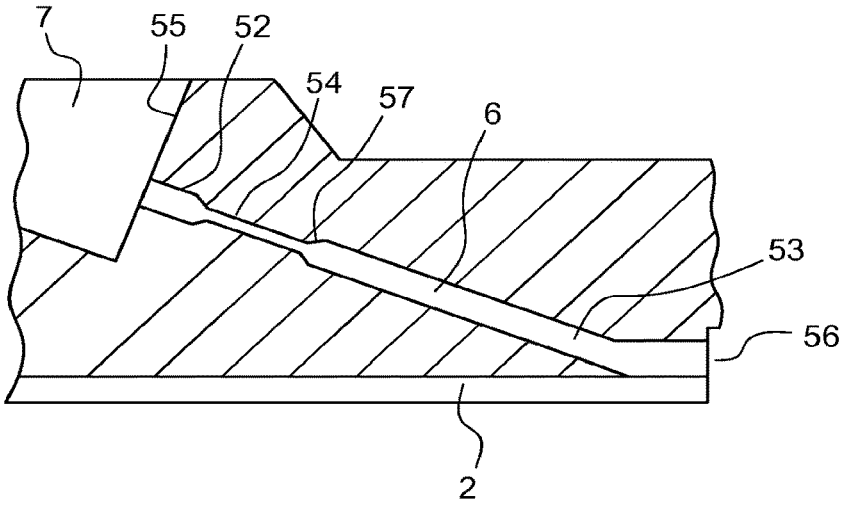
FIG. 5 shows, in cross section, a detail of an equipped tubular component according to one embodiment of the invention.

The opening 6 visible in detail in FIG. 5 may comprise a first section 52 with a first diameter, a second section 53 with a second diameter and a third section 54 with a third diameter that is smaller than the first and second diameters. As a preference, the first and second sections have the same diameter.

The first section of the opening 6 is connected to the third section by a section with a conical surface designed to create a sealing surface.

The electrical conductor comprises a cable of which one section is crimped into a sheath. Said sheath comprises a conical sealing surface able to collaborate with the section of conical surface 57 of the opening 6. The sheath may have a screw thread to allow the sheath to be screwed into the opening 6 in the first section 52 which then comprises a corresponding screw thread, or else in the second section 53 which where appropriate comprises a corresponding screw thread. The screw threads are designed so that, during screwing, the conical surface of the sheath becomes an interference fit with the conical section of the opening 6 to establish a metal-to-metal seal.

The sensor module 12 may comprise at least one sensor chosen from a pressure sensor, a temperature sensor, a fluid flowrate sensor. As a preference, the sensor module comprises a pressure sensor and a temperature sensor. As a further preference, the sensor module comprises a pressure sensor, a temperature sensor, a fluid flowrate sensor. The sensor module may also comprise a pH sensor or else a concentration sensor sensing the concentration of dihydrogen sulfides, of carbon dioxide, of chlorides or of water. For example, the sensor module may comprise microsensors of MEMS type for measuring the pressures and temperatures.

The sensor module may comprise a battery and a memory for storing the measurements taken over the course of time.

The equipped tubular component may comprise a communication module 15. The communication module 15 is connected to the first interior antenna and to the first exterior antenna. The communication module 15 is connected to the sensor module and is designed to transmit the contents of the sensor module memory via the interior and exterior antennas. The communication module 15 comprises electronics designed to receive a signal coming from the interior antenna or from the exterior antenna, to amplify said received signal, and to send the amplified signal via the exterior antenna or the interior antenna respectively.

Figure 7:
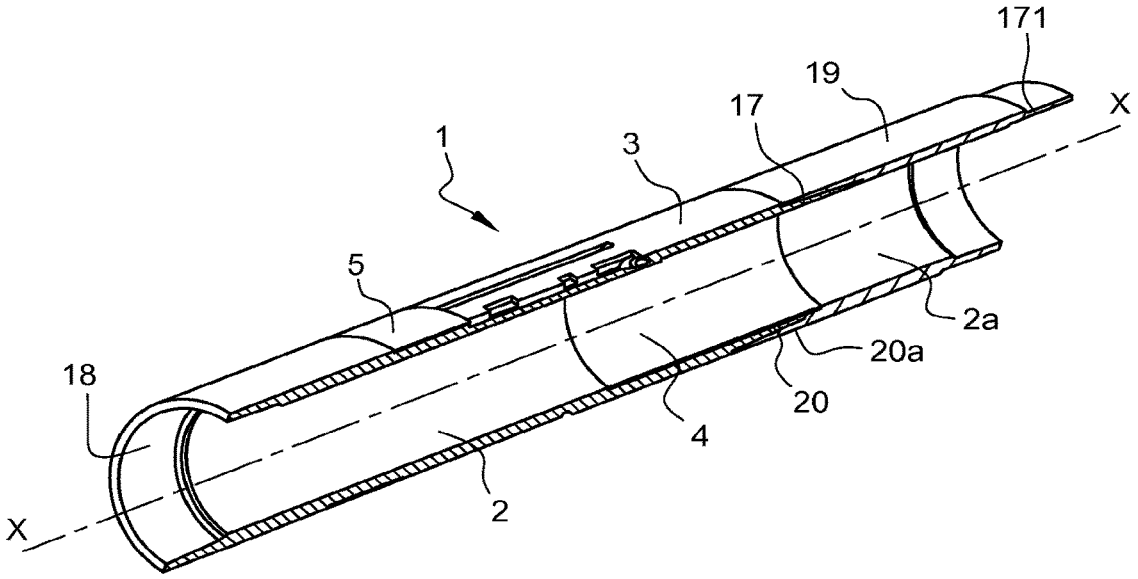
FIG. 7 shows, in partial section, an equipped tubular component according to yet another embodiment of the invention.

In one embodiment, the equipped tubular component 1 comprises a locking sleeve 19 designed to block the interior antenna 4 axially in position. Preferably, the end 17 of the equipped tubular component 1 that is closest to the interior antenna 4 has a first screw thread 20 and the locking sleeve 19 has a second screw thread 20*a* that complements the first screw thread 20 and the locking sleeve 19 is fixed by screwing onto the equipped tubular component 1. FIG. 7 illustrates a variant of this embodiment in which the first screw thread 20 is situated on the exterior surface 3 of the tubular component 1 and the second screw thread 20*a* is situated on the interior surface 2*a* of the locking sleeve 19. Thus, the interior antenna 4 can be inserted inside the equipped tubular component 1, then the locking sleeve 19 can be screwed onto the equipped tubular component 1. This embodiment makes the insertion of the interior antenna 4 easier and makes it possible to avoid its distortion during insertion.

The invention may also apply to the field of pipes for transporting fluids, and more particularly oil and gas pipes used on land or at sea. A pipe may thus comprise an equipped tubular component according to the invention so as to transmit a signal out of the pipe, it being possible for said signal to contain datasets corresponding to measurements taken inside the pipe.

The invention also relates to a method for acquiring and communicating data in an assembly of tubular components comprising at least one equipped tubular component 1 and comprising the steps of:

receiving, via the first exterior antenna 5, a first signal containing information indicative of physical or chemical parameters, emitting via a first interior antenna 4 a corresponding signal comprising containing said information indicative of physical or chemical parameters.

Advantageously, the first signal is received at a first frequency, and the second signal is emitted at a second frequency. Thus signal transmission can be optimized.

In another embodiment, said method may be implemented in an assembly of tubular components comprising at least two equipped tubular components and may comprise the additional steps of:

receiving, via a second exterior antenna, the second signal comprising containing said information indicative of physical or chemical parameters emitting via a second interior antenna a corresponding third signal comprising containing said information indicative of physical or chemical parameters.

Said second signal and said third signal may contain additional information indicative of physical or chemical parameters coming from sensors mounted on the first and second equipped tubular components respectively.

The invention claimed is:

1. An equipped tubular component comprising an interior surface, an exterior surface and a main axis, an interior antenna situated on the side of the interior surface, an exterior antenna situated on the side of the exterior surface, an opening extending from the exterior surface and onto the interior surface, the opening including a section with a conical surface as a sealing surface, and an electrical conductor extending into said opening, the electrical conductor including a cable of which one section is crimped into a sheath, the sheath including a conical sealing surface able to collaborate with the section of conical surface of the opening.

2. The equipped tubular component as claimed in claim 1, comprising a sensor module.

3. The equipped tubular component as claimed in claim 2, wherein the sensor module comprises at least one sensor selected from a pressure sensor, a temperature sensor, a fluid flowrate sensor, a pH sensor, a concentration sensor sensing the concentration of dihydrogen sulfide, of carbon dioxide, of chlorides or of water.

4. The equipped tubular component as claimed in claim 2, wherein the sensor module comprises a pressure sensor, a temperature sensor and a fluid flowrate sensor.

5. The equipped tubular component as claimed in claim 2, wherein the sensor module is arranged on the exterior surface of the equipped tubular component.

6. The equipped tubular component as claimed in claim 2, wherein it comprises at least one exterior pocket able to house the sensor module.

7. The equipped tubular component as claimed in claim 1, further comprising a communication module comprising electronics designed to emit a data signal through an interior antenna or exterior antenna.

8. The equipped tubular component as claimed in claim 7, wherein it comprises at least one exterior pocket able to house the communication module.

9. The equipped tubular component as claimed in claim 1, wherein the interior antenna is an interior winding of a conducting wire and the exterior antenna is an exterior winding of a conducting wire.

10. The equipped tubular component as claimed in claim 1, comprising an external reinforcement on the exterior surface to protect the interior antenna from debris and from the flow of fluids circulating on the outside of the component.

11. The equipped tubular component as claimed in claim 1, wherein it comprises at least one cavity in its exterior surface.

12. The equipped tubular component as claimed in claim 11, wherein it comprises between 2 and 20 cavities and in that these cavities are distributed circumferentially around the equipped tubular component.

13. The equipped tubular component as claimed in claim 1, wherein it comprises a locking sleeve designed to block the interior antenna axially in position.

14. The equipped tubular component as claimed in claim 1, wherein it comprises a screw thread situated at least at one of its ends and in that the screw thread is configured in such a way as to allow screwed connection to another tubular component comprising a complementing screw thread.

15. The equipped tubular component as claimed in claim 1, wherein it is intended for the construction of oil or gas wells.

16. An oil or gas well structure comprising at least a first and a second tube string and at least a first and a second equipped tubular component as claimed in claim 1, the first equipped tubular component being mounted on a first tube string and the second equipped tubular component being mounted on a second tube string, the first tube string being directly adjacent to and concentric with the second threaded tube string.

17. An oil or gas well structure comprising:

at least a first equipped tubular component and a second tubular component as claimed in claim 1, wherein the interior antenna of the first equipped tubular component is a first interior antenna, and the exterior antenna is a first exterior antenna, wherein the interior antenna of the second equipped tubular component is a second interior antenna, and the exterior antenna is a second exterior antenna, wherein the first tubular component is mounted at a given depth in a first string of the oil or gas well, and wherein the second tubular component is mounted in a second string of said oil or gas well, which string is adjacent to the first string, at said given depth, so as to allow a signal to be transmitted between the first and second equipped tubular components.

18. A method for monitoring and for communication in an oil or gas well, comprising:

measuring temperature and pressure conditions at a certain depth in a first annular space using a first sensor module situated on a first equipped tubular component as claimed in claim 1;

measuring temperature and pressure conditions at said certain depth in a second annular space using a second sensor module situated on a second equipped tubular component, the second equipped tubular component includes an interior surface, an exterior surface and a main axis, an interior antenna situated on the side of the interior surface, and an exterior antenna situated on the side of the exterior surface; and transmitting data measured by the second sensor module of the second equipped tubular component to said first equipped tubular component.

* * * * *